US005879233A

United States Patent [19]

Stupero

[11] Patent Number: 5,879,233

[45] Date of Patent: Mar. 9, 1999

[54] DUPLICATE CARD GAME

[76] Inventor: John R. Stupero, 51640 Birch Ave., Rush City, Minn. 55069

[21] Appl. No.: 611,479

[22] Filed: Mar. 29, 1996

[51] Int. Cl.[6] ..... A63F 9/22

[52] U.S. Cl. ..... 463/11; 463/12

[58] Field of Search ..... 463/10, 11, 12, 463/13, 16, 22, 25, 40

[56] References Cited

U.S. PATENT DOCUMENTS

| | | | |
|---|---|---|---|
| 3,796,433 | 3/1974 | Fraley et al. | 463/12 |
| 4,093,215 | 6/1978 | Ballard | 463/11 |
| 4,760,527 | 7/1988 | Sidley | 463/13 |
| 4,995,615 | 2/1991 | Cheng | 463/12 |
| 5,042,818 | 8/1991 | Weingardt | 463/13 |
| 5,275,400 | 1/1994 | Weingardt et al. | 463/13 |
| 5,377,993 | 1/1995 | Josephs | 463/12 |
| 5,415,404 | 5/1995 | Joshi et al. | 463/13 |
| 5,531,440 | 7/1996 | Dabrowski et al. | 463/13 |
| 5,632,485 | 5/1997 | Woodland et al. | 463/12 |
| 5,653,635 | 8/1997 | Breeding | 463/11 |
| 5,669,817 | 9/1997 | Tarantino | 463/13 |

OTHER PUBLICATIONS

Text copy of help file of Bicycle Cribbage computer game by SWFTE International Ltd., Dec. 1994.

*Primary Examiner*—Jessica J. Harrison

*Attorney, Agent, or Firm*—Palmatier, Sjoquist, Voigt & Christensen, P.A.

[57] ABSTRACT

A method and apparatus for playing duplicate card games such as blackjack and poker. In operation, after shuffling an appropriately sized deck, each player is supplied with an identical first hand. From there, each player plays against the dealer or house directly and against each other indirectly. To ensure parity, the shuffled deck is duplicated in its exact order for each player so that each player uses the same identically ordered cards when playing against the dealer or house. Depending on how each player plays, the initially dealt cards (e.g., call, hold, etc.), the relative skill level between players may be measured. After each round played, the deck is reshuffled. A running total for all participants is maintained and each player may wager against the dealer or house in the normal fashion. The apparatus includes a processing unit connected to a plurality of displays each of which includes associated control buttons.

19 Claims, 3 Drawing Sheets

DUPLICATE CARD GAME

BACKGROUND OF THE INVENTION

The present invention relates to a method and apparatus for playing a duplicate card game namely blackjack or poker.

There exits in the prior art a number of methods and apparatus for playing card games. The focus of the prior art has been a card game in which the players play against the dealer representing the House or where the players play against themselves. In the case of blackjack, the players play against a dealer. Each player plays an individual hand dealt from a central group of cards. The group of cards may contain one or more fifty-two playing card decks. A problem in prior art methods and apparatuses for playing blackjack is measuring the relative skill of an individual card player against the skill of the other players.

In the case of poker, the players play against themselves. Before and during each hand, money or chips are placed in a pool and awarded to the winner(s) of that hand. Cards are dealt from a central card group. Each player plays a unique set of cards during the hand. A problem with the prior art method of playing cards is, again, that the skill of an individual player is difficult to measure due to each player playing different sets of cards.

In the prior art it is well known to use a common deck of cards. This common deck of cards is used to deal initial hands and additional cards to players who remain in the game and desire to have additional cards allocated to their playing hand. The problem with prior art use of a common deck of cards is the difficultly in determining the relative skill of one player versus another player due to the varying differences in each players hand as it is dealt from a common deck.

SUMMARY OF THE INVENTION

The present invention relates to a method and apparatus for playing duplicate card games comprising a memory having a plurality of fields for holding a representation of a group of playing cards for each player, a first player group of cards, comprising at least one 52 card deck of playing cards, represented in a first player field, a means for shuffling the first player group to arrange the playing cards in a random order, a means for copying the randomly ordered first player group of cards into a second player field creating an identical second player group of cards, dealing a first player initial and first dealer initial hands from the first group of cards and a second player initial and second dealer initial hands from the second group of cards, displaying the first player hand and the first dealer hand to the first player and the dealer respectively, and the second player hand and the second dealer hand to the second player and dealer respectively, and all player hands and all dealer hands to the dealer, a card call button for requesting additional cards, a hold button for refusing additional cards, a means for keeping score and a means for comparing player scores to determine a winner among players over a series of hands of cards where the group is reshuffled between each hand.

An object of the present invention is to deal each player exactly the same initial hand.

Another object of the invention is provide cards to players where each player group of cards is identically ordered.

Another object of the present invention is that the cards are reshuffled after each round to reorder the cards and provide an identical playing environment for the next round.

A feature of the present invention is all final dealer hands for a particular round may not be identical.

Another feature of the present invention is each player may request or refuse additional cards be added to their player hand.

Another feature of the present invention is each player may have a different number of cards in the final player hand.

Another feature of the present invention in the game may be played simultaneously by players at a game table and on remote slot machines.

DETAILED SPECIFICATION

Figure 1:
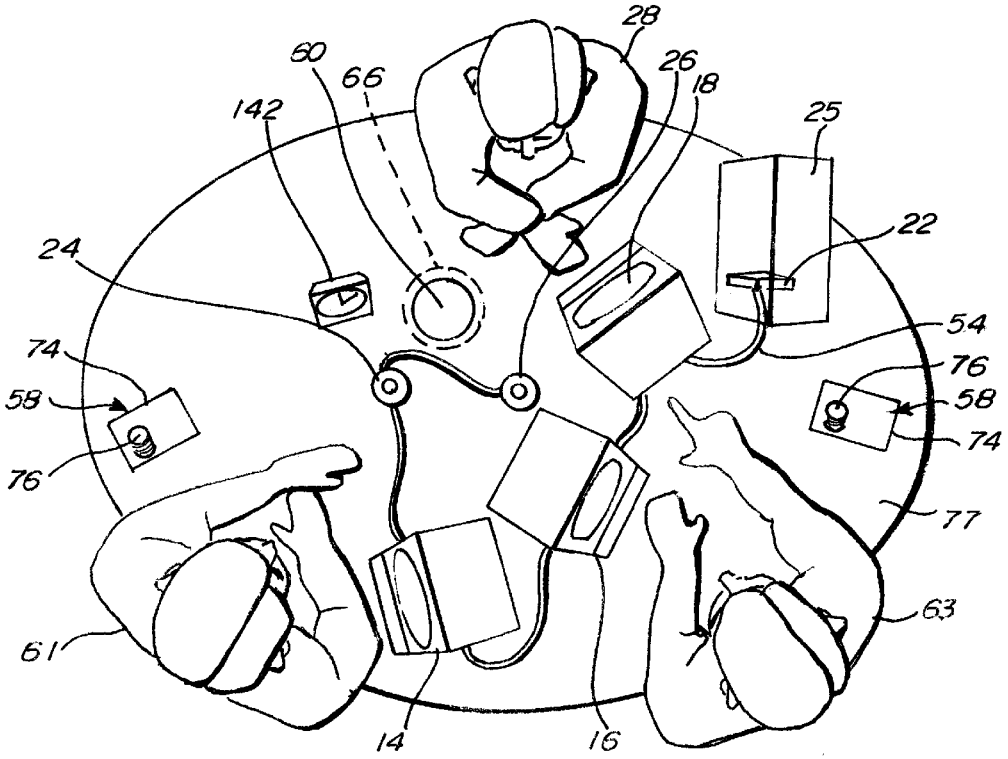
FIG. 1 is a perspective view of a first player and a second player playing a duplicate card game with a dealer.

The apparatus r playing duplicate card game is illustrated in general by the numeral 10. The duplicate card game 10 is described using two players playing a series of rounds 62. The number of players is for illustration. The duplicate card game 10 generally comprises a first player display 14, second player display 16, and dealer display 18.

Central memory 12, communicator 20 and interlock 27 form a portion of the processing unit 22. Processing unit 22 is attached to first player, second player and dealer displays 14, 16, 18 respectively. Call card button 24 and hold button 26 are also connected to processing unit 22 at interlock 27. Processing unit 22 may be mounted in control box 25.

Figure 2:
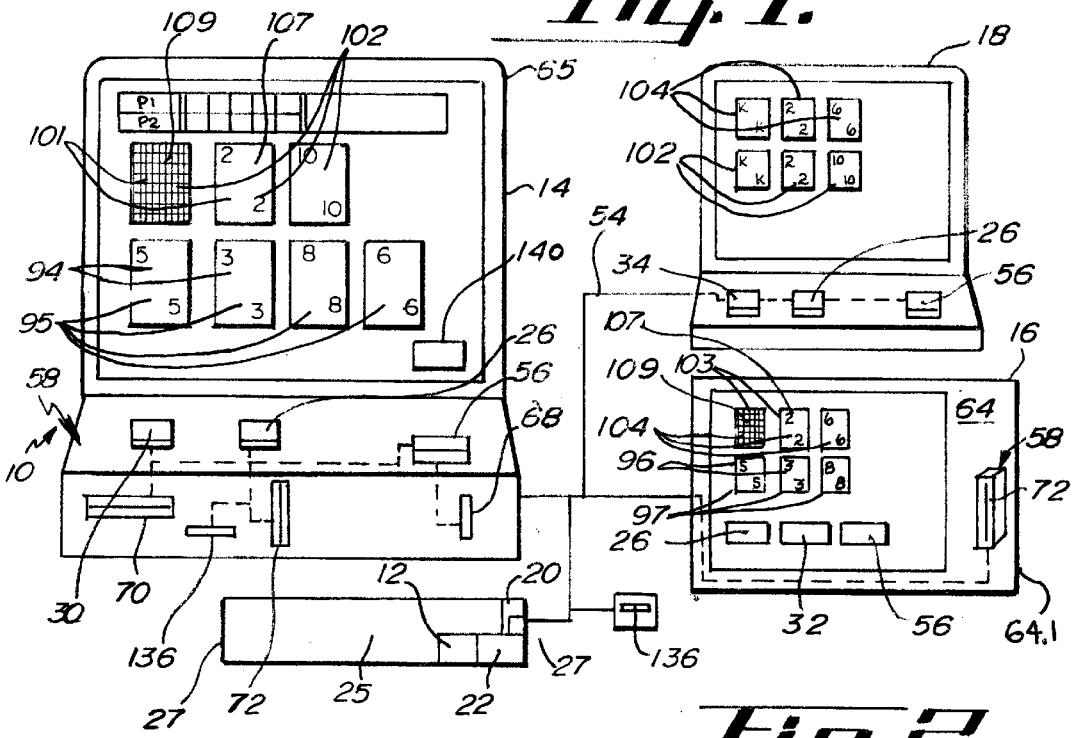
FIG. 2 is an detail view of slot machines connected to a duplicate card game apparatus.
Figure 3:
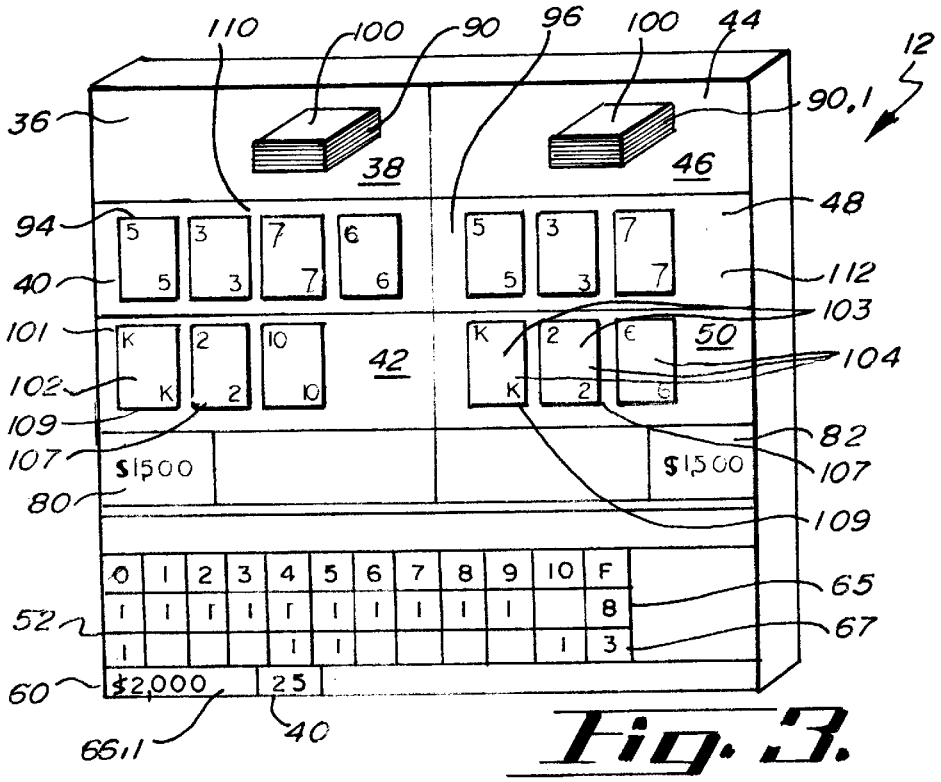
FIG. 3 is a first schematic view of a central memory.

Referring to FIGS. 1–3, the call card button 24 may be centrally located and operated by the dealer 28. Alternatively, the call card button 24 may be connected to the processing unit 22 or may be integral to and positioned adjacent each display as shown in FIG. 2 as indicated by first player call button 30 on first player display 14, second player call button 32 on second player display 16 and dealer call button 34 on dealer display 18.

Referring to FIG. 3 central memory 12 is shown diagrammtically to illustrate fields. Central memory 12 comprises a plurality of fields identified as first player field 36 having first card group field 38, first player hand field 40 and first dealer hand field 42. Second player field 44 is similarly comprised of a second card group field 46, second player hand field 48 and second dealer hand field 50. Central memory 12 further comprises pot score field 52 for storing and comparing first player score 65 to second player score 67 to determine a winner of the kitty or pot 60.

Referring to FIG. 2, first and second player displays 14, 16 respectively are remotely connected to processing unit 22 by network 54. In one embodiment, first and second player displays 14, 16 respectively are first and second slot machines 64, 64.1 respectively having first and second player card call buttons 30, 32, respectively hold buttons 26, and deal new hand buttons 56. Referring to FIGS. 2 and 3, in this embodiment, first player field 36 and second player field 44 in memory 12 are used to control first and second slot machines 64, 64.1 respectively. It should be understood that network 54 allows the first and second slot machines 64, 64.1 respectively to be separated by a few feet or hundreds of miles from control box 25, allowing tournaments to be held in and between separate casinos.

Referring to FIGS. 1–3, the duplicate card game 10 also has a bet receiver 58. Pot bets 76 are placed in a pot 60 to be awarded to the first or second player 61, 63 respectively having the highest score measured by comparing the first and second player score 65, 67 in the pot score field 52 at the end of a predetermined number of rounds 62. Pot 60 may be represented by a container 66 or a pot field 66.1 in central memory 12. Bet receiver 58 may be a coin slot 68, bill slot 70 or credit card reader 72 connected to processing unit 22. A betting area 74, shown in FIG. 1, is used to place a bet 76 at a gambling table 77.

Referring to FIG. 3, a diagrammatic view of central memory 12 is illustrated. First player card group 90 is represented in first card group field 38. Second player card group 90.1 is represented in second card group field 46. The first player initial hand 94 and first player final hand 95 are represented in first player hand field 40. The second player initial hand 96 and second player final hand 97 are represented in second player hand field 48.

Still referring to FIG. 3 the first dealer initial hand 101 and first dealer final hand 102 are represented in first dealer hand field 42. The second dealer initial hand 103 and second dealer final hand 104 are represented in second dealer hand field 50.

Referring to FIGS. 1, 2 and 3, first player 61 uses bet receiver 58 to receive credit for money deposited in duplicate card game 10. The money is represented for first player 61 in first player money field 80. Likewise, money deposited by second player 63 is represented in second player money field 82.

Still referring to FIG. 3, first player score 65 and second player score 67 are represented in pot score field 52. As previously discussed, the amount of money in the pot 60 is represented in pot field 66.1. In addition, the number or series of rounds 62 to be played before awarding the pot 60 to a player is represented in game length field 140.

Figure 4:
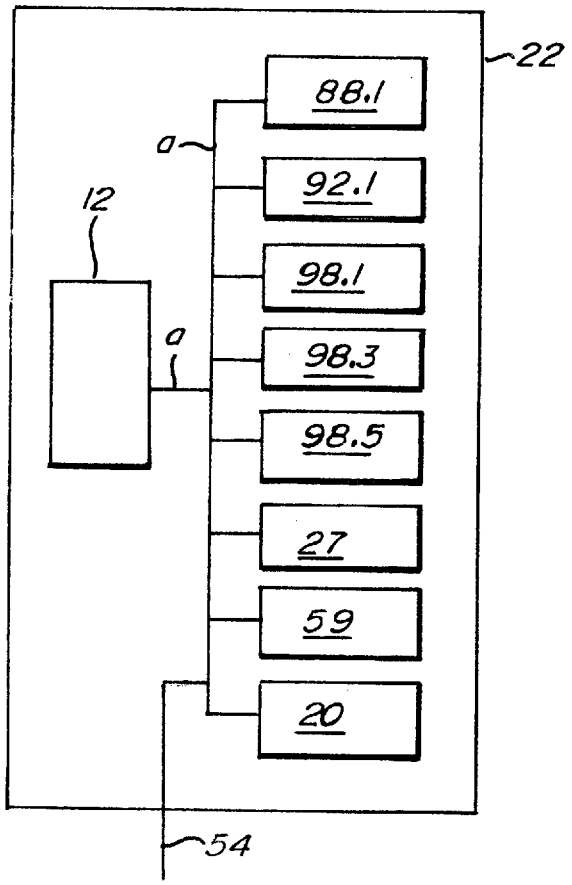
FIG. 4 is a schematic view of the processing unit.

Referring to FIG. 4, the processing unit 22 in duplicate card game 10 is illustrated schematically to show interconnection between elements and central memory 12 to monitor or change one or more fields in central memory 12. Processing unit 22 comprises card shuffler 88.1 which manipulates the first player card group 90 to place the cards in a first random order. Card group copier 92.1 in processing unit 22 copies the first player card group 90 to form second player card group 90.1 in a second random order which is identical to the first random order. It should be understood, a separate card group is created by card group copier 92.1 for each additional player after the first player 61.

Card group copier 92.1 places the second player card group 90.1 in second card group field 46. Dealing the cards is done by card transfer 98.1 which transfers the top card 100 on first player card group 90 to first player hand field 40 or first dealer hand field 42 to form the first player initial and final hands 94, 95 respectively and first dealer initial and final hands 101, 102 respectively. Card transfer 98.1 also transfers the top card 100 on second player card group 90.1 to second player hand field 48 to form second player initial and final hands 96, 97 respectively and to second dealer hand field 50 to form second dealer initial and final hands 103, 104 respectively. It should be understood, the card transfer 98.1 transfers cards based on a predetermined set of rules. Furthermore, it should be understood the top card 100 on first and second player card groups 90, 90.1 represents a new top card 100 each time card transfer 98.1 transfers a top card 100. The subsequent top card 100 is determined by the random order created by card shuffler 88.1.

Still referring to FIG. 4, buster 98.3 in processing unit 22 monitors the value of the cards in each of the first and second player hand fields 40, 48 respectively and the first and second dealer hand fields 42, 50 respectively. Buster 98.3 causes card transfer 98.1 to stop transferring cards to the first or second player or dealer hand fields 40, 48, 42, 50 respectively if the card sum represented in the hand field is above a predetermined number. Comparator 98.5 in processor unit 22 compares the cards represented in the first and second player hand fields 40, 48 respectively and the first and second dealer hand fields 42, 50 respectively to each other according to a predetermined set of rules 105.1 illustrated in FIGS. 5–7.

Continuing to refer to FIG. 4, interlock 27 in processing unit 22 is in communication with communicator 20 and card transfer 98.1 to synchronize card transfers from first player card group 90 and second player card group 90.1. Bettor 59 is in communication with communicator 20, pot field 66.1, first and second player money fields 80, 82 respectively.

Figure 5:
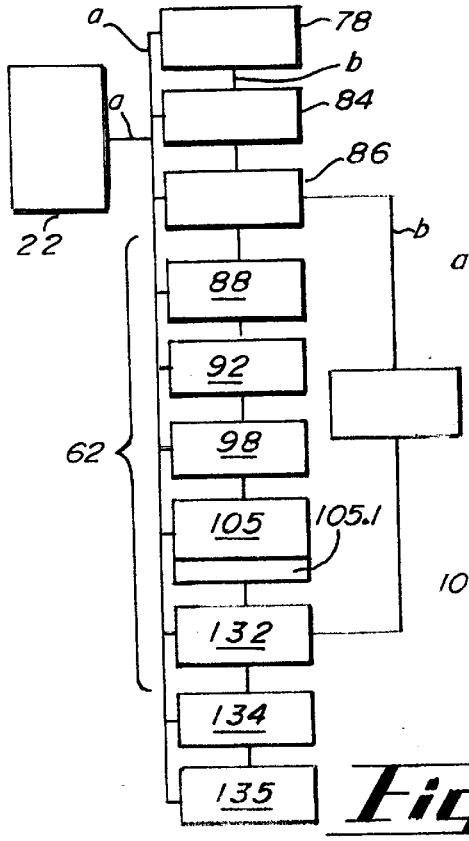
FIG. 5 is a block diagram of the sequence of operations of the apparatus and the processing unit.

Referring to FIGS. 4–7 processing unit 22 performs a sequence of operations shown in block diagram which manipulate central memory 12 and interact with first and second players 61, 63 and dealer 28. Communication lines a and sequence lines b are used to show interacting of the elements in the sequence of operations. FIGS. 4 and 5 illustrate the basic sequence of operations of interaction between elements in the duplicate card game 10. Equalize block 78 may be used to start all players with the same amount of money represented in first and second player money fields 80, 82 respectively. Pot bet block 84 is in communication with bettor 59 and communicator 20 in processing unit 22 to receive information of bets 76 placed at first and second player displays 14, 16 respectively. The amount of money available to be bet by the first player 61 is represented in first player money field 80 and the amount of money available to be bet by second player 63 is represented in second player money field 82. Pot bet block 84 is in communication with bettor 59 to further allocate money from first and second player money fields 80, 82 respectively to pot field 66.1 based on commands received by communicator 20 in communication with first and second player 61, 63 through first and second player displays 14, 16 respectively.

Still referring to FIGS. 4 and 5, round bet block 86 communicates to bettor 59 and communicator 20 to receive signals from first or second player 61, 63 respectively and allocate money from first and second player money fields 80, 82 respectively to bet on the round 62. Bets 76 received by round bet block 86 are deducted from first and second player money fields 80, 82 respectively and wagered on the outcome of the next round 62 based on a predetermined set of rules 105.1.

Still referring to FIG. 5, round 62 comprises shuffle block 88, duplicate block 92, play block 105 and recording score block 132. Shuffle block 88 is in communication with card shuffler 88.1 to randomly order the cards in first player card group 90. Duplicate block 92 is in communication with card group copier 92.1 to make additional, identically ordered card group 90.1. Play block 105 is in communication with card transfer 98.1, buster 98.3 and comparator 98.5 to manipulate the cards in first and second player hand fields 40, 48 and first and second dealer hand field 42, 50 respectively to determine if either or both first and second player 61, 63 are a winner.

Continuing to refer to FIGS. 4 and 5, recording score block 132 is in communication with pot score field 52 to record first and second player score 65, 67 respectively for the first and second players 61, 63 at the end of each round 62. If the number of rounds 62 played is less than the number represented in game length field 140, next round block 138 repeats the steps of round bet block 86, shuffling block 88, duplicating block 92, deal block 98, play block 105 and record score block 132. If the number of rounds 62 played is equal to the number represented in game length field 140, compare score block 145 is in communication with pot score field 152 to compare first and second player scores 65, 67 respectively and select the first or second player 61, 63 as the winner of the game. Pot payout block 135 is in communication with communicator 20 to pay the amount of money represented in pot 60 illustrated in FIG. 2 credits the winner for the amount of the pot.

Figure 6:
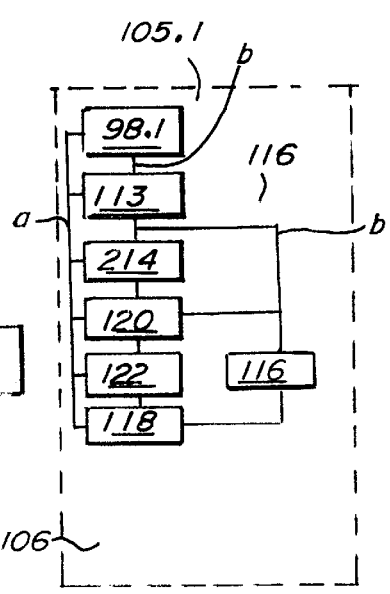
FIG. 6 is block diagram of the rules for playing the game of 21 or blackjack.

Referring to FIGS. 2, 3 and 6, the sequence of operations where the predetermined rules 105.1 are blackjack 106 illustrated. Deal blackjack block 98.2 is connected to card transfer 98.1. Card transfer 98.1 incrementally takes the sequential top cards 100 of first player card group 90 and places a first and second card in first player initial hand 94 and a first down card 109 and second up card 107 in the first dealer initial hand 101. The card transfer 98.1 also incrementally takes the sequential top cards 100 from second player card group 90.1 to similarly transfer the top cards 100 to second player initial hand 96 and second dealer initial hand 103 comprising second dealer down card 109 and second dealer up card 107. It should be understood, the first and second player initial hands 94, 96 respectively are identical to each other and the first and second dealer initial hands 101, 103 are also identical to each other.

Call block 113 is in communication with communicator 22 which receives a signal from first player call button 30 or hold button 26 on first player display 14. If first player call button 30 is engaged, call block 113 engages card transfer 98.1 to take the top card 100 from first player card group 90 and transfer it to first player hand field 40. Simultaneously, the call block 113 may also receive a signal from the second player call button 32 or hold button 26 on second player display 16. If the second player call button 32 is engaged, call block 113 engages card transfer 98.1 to transfer top card 100 from second player card group 90.1 to second player hand field 48.

Referring to FIGS. 2, 3 and 6, if the first sum total of card values represented in first player hand field 40 exceeds twenty-one, the buster 98.3 is in communication with bust block 116 which ends the round for first player 61, and dealer 28 playing the cards represented in first dealer hand field 42 is selected as the round winner by select winner block 118. If the second sum total of card values represented in the second player hand field 48 exceeds twenty one, the buster 98.3 likewise ends the round and select winner block 118 selects the dealer 28, playing the cards represented in second dealer hand field 50, as the winner of the round 62.

If the first player 61 engages the hold button 26 on the first player display 14, hold block 214 communicates to dealer 28 to call or hold and the cards represented in first player hand field 40 represent first player final hand 95. Call dealer cards 120 engages card transfer 98.1 to transfer top cards 100 to dealer hand field 42 until a third sum total representing the value of cards in first dealer hand field 42 is greater then a predetermined limit. This predetermined limit may be seventeen. If the third sum total is greater than twenty-one buster 98.3 engages buster block 116 to bust dealer 28 and select winner block 118 selects first player 61 as a round winner of the round 62. If the third sum total is less than twenty-one, the dealer 28 has the option to engage dealer call button 34 which communicates through communicator 20 to call dealer cards 120 to engage card transfer 98.1 to transfer top card 100 from first player card group 90 to first dealer hand field 42. Any time after the third sum total of cards in first dealer hand field 42 exceeds the predetermined limit, dealer 29 may engage the hold button 26 on dealer display 18 or on gambling table 77 communicating to dealer hold block 122. Dealer hold block 122 forms first dealer final hand 102 from all cards represented in first dealer hand field 42. If third sum total is greater than twenty-one buster 98.3 busts dealer and select winner block 118 selects first player 61 as a round winner.

Similarly, if second player 63 engages hold button 26 on second player display 16, dealer call block 120 engages card transfer 98.1 to transfer top card 100 from second player card group 90.1 to second dealer hand field 50 until the fourth sum total represented by the value of cards in second dealer hand field 50 is greater than the predetermined limit. Likewise if the fourth sum total is greater than twenty-one the buster 98.3 busts dealer and engages select winner block 118 to select second player 63 as a round winner.

Select winner block 118 engages comparator 98.5 to compare the first sum total of first player final hand 95 to third sum total of first dealer final hand 102. If the first sum total exceeds the third sum total, the first player 61 is selected as a round winner of the round 62. Likewise, select winner block 118 engages comparator 98.5 to compare the second sum total of the second player final hand 97 to the fourth sum total of the second dealer final hand 104. If the second sum total exceeds the fourth sum total, the second player 63 is selected as a round winner of the round 62. It should be understood that both first and second players 61, 63 respectively may be a round winner in a round 62 because each plays independently against the dealer 28. Furthermore, if first player 61 or second player 63 are busted by buster 98.3, the dealer hand associated with the busted player is not played.

Figure 7:
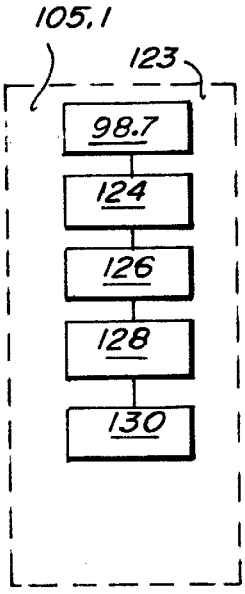
FIG. 7 is a block diagram of the rules for playing poker.

Referring to FIGS. 3, 4 and 7, the predetermined set of rules 105.1 may relate to poker 123. Poker rules 123 are illustrated by a function block diagram in FIG. 7. Deal poker block 98.7 forms an initial first player hand (not shown) by engaging card transfer 98.1 to transfer the top card 100 from first player card group 90 until five cards are represented in first player hand field 40. Similarly, deal poker block 98.7 engages card transfer 98.1 to transfer top card 100 from second player card group 90.1 to form second player initial hand (not shown) represented in second player hand field 48. Discard block 124 communicates with communicator 20 and discards cards selected by first player 61 from first player initial hand (not shown) and cards selected by second player 63 from second player initial hand (not shown). Call block 126 engages card transfer 98.1 which replaces the discarded cards from first and second player initial hands (not shown) with top card 100 from first and second player card groups 90, 90.1 respectively. It should be understood, first and second player initial hands (not shown) are identical. Subsequently, the cards represented in first and second player hand fields 40, 48 respectively may be different. Compare block 128 engages comparator 98.5 to compare a first sum total of cards in the first player hand field 40 to a second sum total defined by the cards represented in the second player hand field 48. The first and second sum totals are assigned by comparator 98.5 based on card combination rankings well known in the art of poker (three of a kind beats a pair, etc.).

Select winner block 130 selects the first player 61 as a round winner if the first sum total is greater than the second sum total. Select winner block 130 selects the second player 63 as a round winner if the second sum total is greater than the first sum total. Both first and second players 61, 63 respectively may be selected as a round winner by select winner block 130 if the first sum total is equal to the second sum total.

Referring to FIGS. 5–7, select winner blocks 118 and 130 respectively engage and record score block 132 records the first and second player score 65, 67 respectively. First and second player score 65, 67 respectively, may be increased incrementally upwards, by a predetermined winning number, if the first or second player 61, 63 respectively is selected as a round winner by select winner block 118 or 130 or incrementally increased or decreased, a predetermined losing number, if the first or second player 61, 63 respectively is not selected as a round winner. First and second player score 65, 67 may also be incremented up or down after each round 62, an amount proportional to the bet received by round bet block 86, or in proportion to the sum total value of the cards represented in first and second player hand fields 40, 48 respectively.

Referring to FIG. 5 if the number of rounds 62 played is equal to the number represented in game length field 140, compare score block 134 engages comparator 98.5 to compare the value of first player score 65 to the value of second player score 67. Comparator 98.5 selects the player with the largest score as the pot winner of the pot 60. As illustrated in FIG. 3, first player score 65 of eight (8) is larger than second player score 67 of three (3) and first player 61 is winning after ten rounds 62 in a twenty-five round 62 game.

Still referring to FIGS. 2 and 5, pot payout block 135 transfers the contents of the pot 60 represented in pot field 60.1 to the pot winner by communication to communicator 20 and engaging payout 136 illustrated in FIG. 2 on first player display 14 or connected independently to network 54.

Referring to FIG. 2, payout 136 may be a printer to print a winner slip to be cashed in with dealer 28.

In operation, first and second players 61, 63 respectively place a bet 76 into the pot 60 and agree to play a predetermined number 140 of rounds 62 to determine a pot winner of the money in the pot 60. As described above, the first and second player 61, 63 respectively play each round from a separate, identically ordered first and second player card groups 90, 90.1 respectively represented in memory 12. The game is played by predetermined rules 105.1. A new first and second card group 90, 90.1 respectively is used for each round 62.

As illustrated in FIGS. 2, 3 and 5–7, first and second player card groups 90, 90.1 respectively are represented as having the top seven sequential cards in order as a five, king, three, two, seven, six and ten. When first and second players 61, 63 respectively play blackjack 106, deal blackjack block 98.2 engages card transfer 98.1 to allocate the five to the first and second player hand field 40, 48 respectively, the king to the first and second dealer hand, field 42, 50 respectively face down 109, the three face up 107 to the first and second player hand fields 40, 48 respectively, and the two face up 107 to the first and second dealer hand field 42, 50 respectively. Both the first and second player initial hands 94, 96 respectively contain a five and a three. Both the first and second dealer initial hands 101, 103 respectively contain a face down king 109 and a face up two 107.

Further describing the hand as illustrated, first player 61 engages call block 113 twice to have the seven and six added to first player hand field 40. First player 61 engages hold button 26 on first player display 14. The first sum total of the values of the cards in first player final hand 95 is twenty-one. Buster 98.3 does not bust first player 61. The third sum value of cards in first dealer hand field 42 is twelve (10 (king)+2). If the predetermined limit is 17, card transfer 98.7 transfers top card 100, a ten from first player card group 90 to first dealer hand field 42. Buster 98.3 calculates that third sum value of cards in first dealer hand field 42 is greater than twenty-one and communication to bust block 116 to select first player 61 as a round winner for the round 62.

Still referring to FIGS. 2, 3 and 5–7, simultaneously, second player 63 engages call block 113 once to receive a seven into second player hand field 48. Second player 63 has second sum total of twelve. Second player 63 engages hold button 26 on second player display 16 which engages hold block 114. Dealer call block 120 engages card transfer 98.1 to transfer top card 100, a six, from second player card group 90.1. Dealer 28 engages hold button 26 on gambling table 77 or dealer display 18 and compare block 122 compares second player hand field 48 having a second sum total of twelve to second dealer hand field 50 having a fourth sum total of eighteen. In this round, second player 63 is not selected as a round winner.

Interlock 27 prevents first player 61 from observing the value of the top card 100 called by second player 63 before all players have indicated call or hold. Time clock 142 is used to hasten play. It should be understood, interlock 27 may be eliminated by alternatively forming a group of cards 90 for each round 62. In this manner, if ten rounds 62 were to be played, ten initial first player card groups 90 are each, individually shuffled to place them in a separate random order. A set of ten second player card groups 90.1 identical to the ten initial first player card groups 90 are created for the second player 63. The first and second player 61, 63 respectively play each round 62 using one of the prearranged respectively allocated card groups 90, 90.1. The results after ten rounds 62 is each player has played a round 62 with each of the ten prearranged first and second player card groups 90, 90.1 respectively.

By example, if ten identical first player card groups 90 are created and shuffled by shuffler 88.1 and a duplicate set of the ten second player card groups 90.1 are created for second player 63 by card group copier 92.1. First player 61 may play the first player card groups 90 in ascending order 1–10. Second player 63 may play the second player card groups 90.1 in descending order 10–1. This method eliminates the need to isolate the first and second players 61, 63 respectively from each other while still allowing each player to independently play the same first and second card group 90, 90.1 respectively during the duplicate card game.

It should be understood the method and apparatus for playing duplicate card game 10 may be used at a gambling table 77 as in a casino, by connecting a first and a second slot machines 64, 64.1 respectively together with network 54, as a home video game or as a game show. The object is to standardize the playing environment across several players to more precisely measure the relative skill of the first and second player 61, 63 respectively. The pot 60 is an incentive used to hold first and second players 61, 63 respectively to a particular duplicate card game 10 for a number of rounds 62.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

In the claims:

1. A method of playing a card game between a first player and a second player comprising:

placing a bet to define a pot;

arranging a first player card group of playing cards in a first random order for the first player;

arranging a second player card group of cards for the second player in a second random order which is identical to the first random order;

dealing a first player hand of cards from the first player card group and a second player hand of cards from the second player card group;

consecutively dealing additional cards in accordance with a predetermined set of rules to the first player from the first player card group and consecutively dealing additional cards to the second player from the second player card group;

determining whether the first player is a round winner and determining whether the second player is a round winner;

recording a first player score and recording a second player score in accordance with the predetermined set of rules;

selecting a pot winning player by comparing the first player score to the second player score to identify the first player as the pot winning player if the first player score is greater than the second player score or to identify the second player as the pot winning player if the second player score is greater than the first player score; and paying the pot to the pot winning player.

2. The invention of claim 1 further comprising placing a bet to define a round bet.

3. The invention of claim 2 wherein the first player score or second player score is changed by adding or subtracting a predetermined percentage of the round bet.

4. The invention of claim 2 further comprising changing the first player score or second player score by adding a predetermined number to the first player score if the first player is a round winner and adding the predetermined number to the second player score if the second player is a round winner.

5. The invention of claim 1 further comprising tabulating the number of times that the first player is a round winner and the number of times the first player is not a round winner prior to paying the pot.

6. The invention of claim 1 the predetermined set of rules comprising:

discarding cards from the first player hand by the first player and replacing each discarded card from the first player hand with a card called from the first player card group;

discarding cards from the second player hand by the second player and replacing each discarded card from the second player hand with a card called from the second player card group; and allocating a first sum total to the first player hand and second sum total to the second player hand based on a predetermined ranking of card combination values.

7. An apparatus for simulating the playing of a duplicate card game in combination with a first player and a second player, the apparatus comprising:

a processing unit having a card shuffler, a card group copier, a memory, a buster, a comparator, a communicator, and a card transfer;

a memory in the processing unit comprising a plurality of fields including a first player field and a second player field;

a first player display connected to the processing unit, a second player display connected to the processing unit;

a bet receiver connected to the processing unit;

a payout connected to the processing unit;

a call button connected to the processing unit;

a hold button connected to the processing unit;

a means for representing a first player card group of playing cards having a first random order of cards and a top card in the memory;

a second player card group formed by the card group copier in communication with the first player card group, a second player card group having a second random order and a top card, the second random order being identical to the first random order;

a first player hand formed by the card transfer in communication with the first player card group and the first player field, a second player hand formed by the card transfer in communication with the second player card group and the second player field;

a means for playing a round of a card game by the first player using the first player card group and the second player using the second player card group; and a means for selecting a round winner.

8. The invention of claim 7 further comprising an interlock in the processing unit whereby the transfer of cards by the card transfer is synchronized.

9. The invention of claim 7 further comprising a network extending from the first player display to the second player display, the network being in communication with the processing unit.

10. The invention of claim 7 further comprising a dealer display connected to the processing unit.

11. The invention of claim 7 further comprising a call button on the first player display and a call button on the second player display.

12. The invention of claim 7 further comprising a bet receiver on the first player display.

13. The invention of claim 7 further comprising:

a player score field in the memory having a first player score and a second player score;

a means for changing the first player score and the second player score;

a means for comparing the first player score to the second player score; and a means for determining a pot winner.

14. A duplicate card game for simulating the playing of card game comprising:

a first and a second slot machine, each slot machine having a display, a call button and a hold button;

a control box having a processing unit comprising a memory and a card group copier, the memory having a first player field and a second player field;

a means for playing a round of card game in the processing unit;

a means for keeping score;

a bet receiver in communication with the processing unit;

a pot payout in communication with the processing unit;

a means for setting a game length comprising a predetermined number of rounds to be played in communication with the processing unit; and a payout.

15. The invention of claim 14 further comprising:

a means for playing a predetermined number of rounds of the card game;

a pot;

a means for allocating a bet to the pot, the pot being connected to the processing unit; and a means for selecting a pot winner whereby the pot is paid to the pot winner.

16. The invention of claim 15 further comprising a network connected between the processing unit and the first slot machine, the network also connecting the first slot machine to the second slot machine.

17. The invention of claim 14 further comprising a means for selecting a predetermined set of rules.

18. The invention of claim 16 further comprising a gambling table having a dealer display therein, the dealer display connected to the network and in communication with the processing unit.

19. The invention of claim 18 further comprising a first player display on the gambling table, the first player display connected to the network and in communication with the processing unit.

* * * * *